US011731000B2

(12) United States Patent
Beecroft et al.

(10) Patent No.: US 11,731,000 B2
(45) Date of Patent: Aug. 22, 2023

(54) FLY WHEEL RESISTANCE WORKOUT SYSTEM

(71) Applicants: Wesley Beecroft, Oregon City, OR (US); Jeffrey Roshak, Oregon City, OR (US)

(72) Inventors: Wesley Beecroft, Oregon City, OR (US); Jeffrey Roshak, Oregon City, OR (US)

( * ) Notice: Subject to any disclaimer, the term of this patent is extended or adjusted under 35 U.S.C. 154(b) by 217 days.

(21) Appl. No.: 17/398,117

(22) Filed: Aug. 10, 2021

(65) Prior Publication Data

US 2022/0047909 A1 Feb. 17, 2022

Related U.S. Application Data

(60) Provisional application No. 63/065,769, filed on Aug. 14, 2020.

(51) Int. Cl.

| | |
|---|---|
| ***A63B 21/22*** | (2006.01) |
| ***A63B 21/16*** | (2006.01) |
| ***A63B 21/00*** | (2006.01) |

(52) U.S. Cl.

CPC ..... *A63B 21/225* (2013.01); *A63B 21/153* (2013.01); *A63B 21/156* (2013.01); *A63B 21/169* (2015.10); *A63B 21/4035* (2015.10)

(58) Field of Classification Search

CPC ..... A63B 21/00058; A63B 21/00069; A63B 21/00072; A63B 21/00076; A63B 21/0056; A63B 21/0057; A63B 21/012; A63B 21/0125; A63B 21/015; A63B 21/018; A63B 21/15; A63B 2225/09; A63B 2225/093

See application file for complete search history.

(56) References Cited

U.S. PATENT DOCUMENTS

| | | | | | |
|---|---|---|---|---|---|
| 2,977,120 | A * | 3/1961 | Morris | A63B 21/156 | 482/103 |
| 3,438,627 | A * | 4/1969 | La Lanne | A63B 21/156 | 482/103 |
| 4,199,139 | A * | 4/1980 | Mahnke | A63B 21/0632 | 482/101 |
| 4,549,733 | A * | 10/1985 | Salyer | A63B 23/03525 | 482/133 |

(Continued)

FOREIGN PATENT DOCUMENTS

| | | |
|---|---|---|
| WO | 2019097027 | 11/2018 |
| WO | 2019199352 | 10/2019 |

*Primary Examiner* — Gary D Urbiel Goldner
(74) *Attorney, Agent, or Firm* — Mohr Intellectual Property Law Solutions, PC

(57) ABSTRACT

A fly wheel resistance workout system is provided. One embodiment includes a plurality of braces secured into at least one of a floor surface and a wall surface, wherein each one of the plurality of braces on the floor surface or the wall surface is located at a predefined location on the floor surface or the wall surface; a removeable anchor that can be releasably secured to one of the plurality of braces such that the removeable anchor is secured to the floor surface or the wall surface at a location of interest; a grab bar that is grasped by a user during an exercise motion; a fly wheel resistance device that opposes the exercise motion made by the user; and a strap with an end that is coupled to the fly wheel resistance device and with an end that is coupled to the grab bar.

18 Claims, 12 Drawing Sheets

(56) References Cited

U.S. PATENT DOCUMENTS 5,042,798 A * 8/1991 Sawicky ..... A63B 21/157 482/73
5,195,937 A * 3/1993 Engel ..... A63B 21/015 482/133
6,319,179 B1 * 11/2001 Hinds ..... A63B 21/0552 482/121
6,394,935 B1 * 5/2002 Lake ..... A63B 21/4013 482/93
6,551,226 B1 * 4/2003 Webber ..... F16B 7/105 482/148
7,604,576 B2 * 10/2009 Drechsler ..... A63B 21/4017 482/99
7,625,325 B1 * 12/2009 Yost ..... A63B 21/169 482/904
9,339,682 B2 * 5/2016 Braier ..... A63B 21/1618
10,080,917 B2 * 9/2018 Freudinger ..... A63B 21/0442
10,814,172 B1 * 10/2020 Ilfrey ..... A63B 23/035
11,628,328 B2 * 4/2023 Valente ..... A63B 21/156 482/5
2002/0091043 A1 * 7/2002 Rexach ..... A63B 21/0628 482/99
2002/0119869 A1 * 8/2002 Whited Lake ..... A63B 21/1645 482/93
2003/0109324 A1 * 6/2003 Novotny ..... A63B 69/3623 473/257
2003/0115955 A1 * 6/2003 Keiser ..... A63B 23/12 73/379.06
2005/0009672 A1 * 1/2005 Yeh ..... A63B 21/153 482/114
2007/0054785 A1 * 3/2007 Drechsler ..... A63B 21/156 482/94
2007/0161472 A1 * 7/2007 Drechsler ..... A63B 21/4017 482/99
2008/0300118 A1 * 12/2008 Wehrell ..... A63B 21/169 482/129
2009/0181833 A1 * 7/2009 Cassidy ..... A63B 21/156 482/92
2010/0173759 A1 * 7/2010 Lalaoua ..... A63B 21/4005 482/121
2012/0277068 A1 * 11/2012 Zhou ..... A63B 21/157 482/71
2013/0337981 A1 * 12/2013 Habing ..... A63B 21/0618 482/110
2014/0038777 A1 * 2/2014 Bird ..... A63B 23/03525 482/5
2014/0106949 A1 * 4/2014 Mestemaker ..... A63B 21/1636 482/129
2015/0182773 A1 * 7/2015 Olson ..... A63B 23/03541 482/92
2015/0246258 A1 * 9/2015 Hockridge ..... A63B 21/156 482/99
2015/0352395 A1 12/2015 Gregory
2016/0121156 A1 * 5/2016 Bach ..... A63B 21/0087 482/112
2017/0197104 A1 7/2017 Turner
2018/0311523 A1 * 11/2018 Arturo ..... A63B 21/0626
2018/0361200 A1 * 12/2018 Walker ..... A63B 21/4033
2019/0076691 A1 * 3/2019 Smith ..... A63B 23/1209
2019/0099632 A1 * 4/2019 Orady ..... A63B 21/4035
2019/0099633 A1 * 4/2019 Orady ..... A63B 21/15
2019/0099637 A1 * 4/2019 Valente ..... A63B 1/00
2019/0099652 A1 * 4/2019 Orady ..... A63B 23/03541
2019/0134448 A1 * 5/2019 Habing ..... A63B 21/0055
2019/0275363 A1 * 9/2019 Jones ..... A63B 21/0616
2019/0299043 A1 * 10/2019 Gisin ..... A63B 21/4035
2020/0114195 A1 * 4/2020 Henniger ..... A63B 21/4043
2020/0254309 A1 * 8/2020 Watterson ..... A63B 21/154
2020/0289866 A1 * 9/2020 Gvoich ..... A63B 21/4043
2021/0170218 A1 * 6/2021 Lewis-Dove ..... A63B 17/04
2021/0244995 A1 * 8/2021 Andrei ..... A63B 21/1663
2021/0402246 A1 * 12/2021 Stegeman ..... A63B 21/16
2022/0184445 A1 * 6/2022 Fortuin ..... A63B 24/0087

* cited by examiner

FLY WHEEL RESISTANCE WORKOUT SYSTEM

PRIORITY CLAIM

This application claims priority to U.S. Application Ser. No. 63/065,769, filed on Aug. 14, 2020, entitled Systems and Methods For Fly Wheel Workout System, which is hereby incorporated by reference for all purposes.

BACKGROUND OF THE INVENTION

In the arts of exercise systems, and in particular fly wheel resistance workout systems, a variety of workout systems are known. When a user is performing an exercise using a legacy fly wheel workout system, the user begins by grasping a grab bar. The grab bar is coupled to the fly wheel resistance device using a suitable strap, rope, cable, or the like. As the user pulls on the grab bar, the fly wheel resistance device exerts an opposing force on the strap, rope, cable, or the like in resistance to the pulling force exerted by the user.

One type of legacy fly wheel resistance workout system is a floor mounted workout system. The floor mounted legacy fly wheel resistance workout system allows the user to perform a variety of floor-based workout movements. Another type of legacy fly wheel resistance workout system is a wall mounted workout system. The wall mounted legacy fly wheel resistance workout system allows the user to perform a different variety of wall-based workout movements.

Typically, an exercise area includes a floor mounted legacy fly wheel resistance workout system and includes a separate wall mounted legacy fly wheel resistance workout system. One disadvantage of a separate workout systems is that the two workout systems require two separate installation areas in the exercise area. Further, if a user finishes exercising on one of the workout systems, and is ready to move over to the other workout system, the user might have to wait for another user to finish working out on that next workout system.

Accordingly, there is a need in the art to provide an improved fly wheel resistance apparatus and method.

SUMMARY OF THE INVENTION

Embodiments of the removeable anchor provide a system and method for a user to change exercises using a fly wheel resistance workout system. One embodiment includes a plurality of braces secured into at least one of a floor surface and a wall surface, wherein each one of the plurality of braces on the floor surface or the wall surface are located at predefined locations on the floor surface and the wall surface; a removeable anchor that can be releasably secured to one of the plurality of braces such that the removeable anchor is secured to a floor surface or a wall surface at a location of interest; a grab bar that is grasped by a user during an exercise motion; a fly wheel resistance device that opposes the exercise motion made by the user; and a strap with an end that is coupled to the fly wheel resistance device and with an end that is coupled the grab bar.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
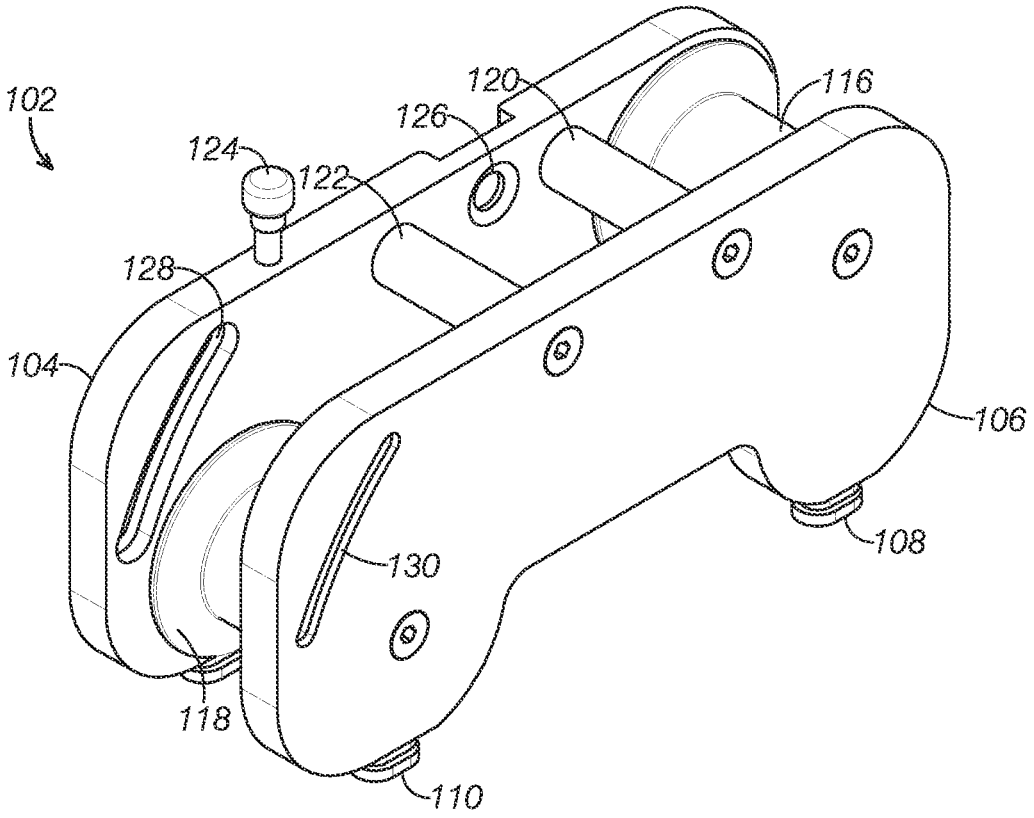
FIG. 1 is a perspective view of an embodiment of a removeable anchor used in an embodiment of a fly wheel resistance workout system.
Figure 2:
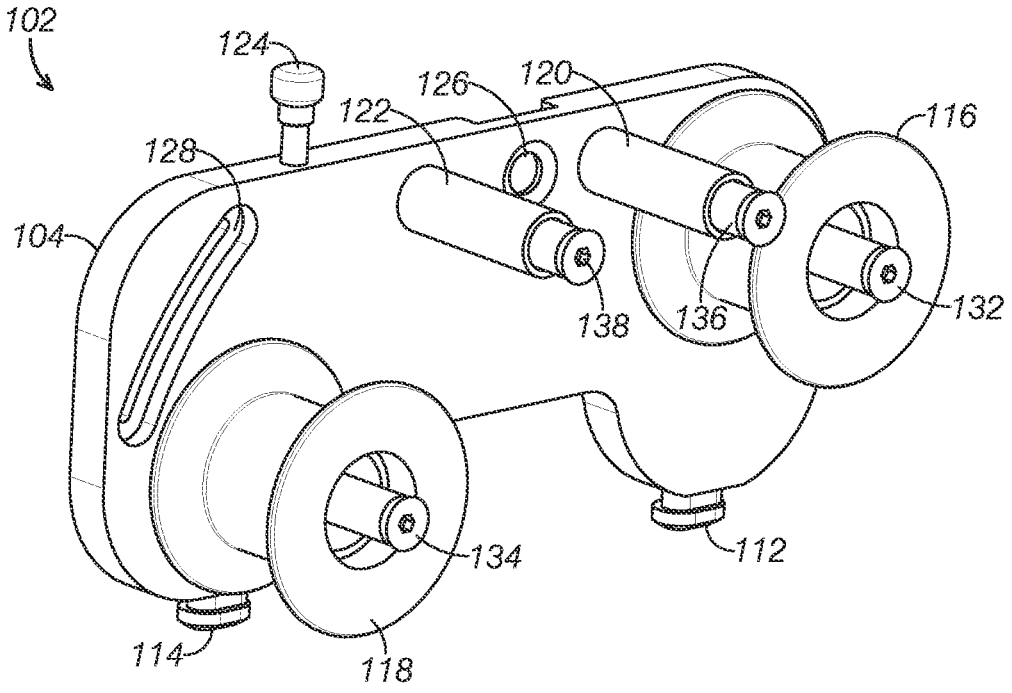
FIG. 2 is a perspective view of the internal region of an embodiment of the removeable anchor.

FIG. 1 is a perspective view of an embodiment of a removeable anchor 102 used in an embodiment of a fly wheel resistance workout system 100. FIG. 2 is a perspective view of the internal region of an embodiment of the removeable anchor 102.

The disclosed systems and methods for a fly wheel resistance workout system 100 will become better understood through review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations, however, for the sake of brevity, each and every contemplated variation is not individually described in the following detailed description.

Throughout the following detailed description, a variety of examples for systems and methods for the fly wheel resistance workout system 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components. "Secured to" means directly connected without intervening components.

Returning to FIGS. 1 and 2, the non-limiting exemplary removeable anchor 102 comprises a first anchor wall 104, an opposing second anchor wall 106, attachment member 108, 110, 112, 114, a first pully 116, a second pulley 118, a first retainer bar 120, a second retainer bar 122, and a lock plunger 124. An optional aperture 126 is disposed in the first anchor wall 104 proximate to the middle of a selected side of the anchor walls 104, 106. The aperture 126 is used to hang the removeable anchor 102. A curved anchor radial slot 128 is disposed in the first anchor wall 104 proximate to a leading edge of the first anchor wall. A curved anchor radial slot 130 is similarly disposed through the second anchor wall 106.

A first axle 132 extends through the first pulley 116. A second axle 134 extends through the second pulley 118. The axles 132 and 134 are sized to permit the pulleys 116, 118 to freely rotate as a strap, rope, cable, or the like is drawn through the fly wheel resistance workout system 100 during an exercise.

In a non-limiting example embodiment, a first optional spacing rod 136 extends through the first retainer bar 120. A second optional spacing rod 138 extends through the second retainer bar 122. The retainer bars 120, 122 are proximate to an exterior surface 140 of the first anchor wall 104 and the opposing second anchor wall 106, are substantially parallel with each other, and are inside of the location of the two pulleys 116, 118. In some embodiments, the retainer bars 120, 122 and the spacing rods 136, 138, respectively, are formed as a unibody member. Alternative embodiments that employ any suitable number of retainer bars and spacing rods are intended to be within the scope of this disclosure and to be protected by the accompanying claims.

Preferably, the outside surface of the retainer bars 120, 122 are coated with a material that has a minimal friction coefficient that is less than the friction coefficient of the material of the retainer bars 120, 122. The low friction coefficient reduces frictional drag exerted on the strap by the removeable anchor 102 when the user is performing an exercise motion (interchangeably referred to herein as an exercise movement). In some embodiment the first retainer bar 120 and the spacing rod 138, and the second retainer bar 122 and the second spacing rod 138, are made as a unibody structure.

The length of the axles 132, 134 and the spacing rods 136, 138 are substantially the same such that, when the first anchor wall 104 and the second anchor wall 106 are affixed to the axles 132, 134 and the spacing rods 136, 138, the first anchor wall 104 and the second anchor wall 106 are securely held together in a parallel and edge aligned manner. That is, the parallel anchor walls 104, 106 have their respective edges substantially aligned with each other. The axles 132, 134 and the spacing rods 136, 138 may be secured to the first anchor wall 104 and the second anchor wall 106 using a suitable fastener, such as a screw, a bolt, a pin, a rivet, a weld, an adhesive, or the like.

The attachment members 108, 110, 112, 114 are disposed on a second exterior surface 142 of the first anchor wall 104 and the second anchor wall 106 (that opposes the exterior surface 140). In the illustrated example embodiment, two of the attachment members 108, 110 are disposed on opposing ends of the exterior surface 142 of the second anchor wall 106. The other two attachment members 112, 114 are disposed on opposing ends of the first anchor wall 104. Accordingly, the four attachment members 108, 110, 112, 114 are located so as to form a rectangular perimeter. Alternative embodiments may use any suitable number of attachment members. In an example embodiment, the attachment members 108, 110, 112, 114 are keyhole feet. Alternative embodiments that use alternative attachment means now known or later devised are intended to be within the scope of this disclosure and to be protected by the accompanying claims.

In a preferred embodiment, the attachment members 108, 110, 112, 114 are configured to removably secure the removeable anchor 102 to selected braces 406, 402 (FIG. 4) disposed in a wall surface and/or a floor surface depending upon the particular exercise that the user wishes to perform. In practice, the wall surface and floor surface contain a plurality of braces with attachment openings (apertures) that are configured to receive and secure the attachment members 108, 110, 112, 114. Each of the attachment members 108, 110, 112, 114 are defined by a protruding tubular shaft of a predefined diameter. The attachment members 108, 110, 112, 114 terminate in a lock nut at the distal end of the shaft and having a predefined diameter that is larger than the diameter of the protruding shaft. In other types of attachment systems, the shaft and/or the terminal lock nut may employ other shapes rather that circular portions.

The attachment aperture is defined by an opening that is configured to receive terminal lock nut of the attachment members 108, 110, 112, 114, and a slot extending away from the opening. The slot has a width corresponding to the diameter of the protruding shaft of the attachment members 108, 110, 112, 114 (wherein the width of the slot is less than the diameter of the terminal lock nut). Once the terminal lock nut is inserted into the opening, the protruding shaft of the attachment members 108, 110, 112, 114 are slid into the slot. Once the attachment members 108, 110, 112, 114 of the removeable anchor 102 are slid into place within the slots, the larger diameter of the terminal nut is restrained by the narrower slot. That is, the removeable anchor 102 is secured in place when the plurality of attachment members 108, 110, 112, 114 are engaged (inserted into and then slidably moved) into the corresponding one of the plurality of attachment openings 508 of the brace 302. 406. An example embodiment utilizes a key hole attachment system.

Alternatively, the first retainer bar 120 and the second retainer bar 122 are used to releasably secure the removeable anchor 102 to a wall surface. The wall surface has disposed therein a plurality of outwardly protruding hooks that are configured to concurrently receive the first retainer bar 120 and the second retainer bar 122 of the removeable anchor 102. In a preferred embodiment, two outward and upward pointing protruding hooks extend outwardly from the wall. When the removeable anchor 102 is secured to the wall using the first retainer bar 120 (which engages a first one of upward pointing protruding hooks) and the second retainer bar 122 (which engages the second one of the upward pointing protruding hooks), gravity holds the removeable anchor 102 in place during the user's workout.

During a workout, the user is able to detach the removeable anchor 102 easily and conveniently from the floor surface and/or the wall surface, and then reattach the removeable anchor 102 to another location on either the wall surface and/or the floor surface using either of the attachment members 108, 110, 112, 114 or the retainer bars 120, 122. Once the user has secured the removeable anchor 102 in a desired location, the user actuates the lock plunger 124 to secure the removeable anchor 102 in its current location. The lock plunger 124 extends a locking pin into an aperture on the brace to lock the removeable anchor 102 in place during the user's exercise movement.

After the user has completed a particular workout movement using the fly wheel resistance workout system 100 that is secured in place by the removeable anchor(s) 102, the removeable anchor(s) 102 can be detached from the floor surface and/or wall surface by the user by first releasing the lock plunger 124. Then, the removeable anchor(s) 102 can be repositioned by the user for another different workout movement.

In a non-limiting example embodiment, a first spacing rod 136 extends through the first retainer bar 120. A second spacing rod 138 extends through the second retainer bar 122. Preferably, the outside of the retainer bars 120, 122 are coated with a material that has a minimal friction coefficient. In some embodiment the first retainer bar 120 and the spacing rod 138, and the second retainer bar 122 and the second spacing rod 138, are made as a unibody structure. In some embodiments, the retainer bars and the spacing rods are formed of a unibody piece of material (and are generically referred to herein as retainer bars for brevity.)

The length of the axles 132, 134 and the spacing rods 136, 138 are substantially the same such that, when the first anchor wall 104 and the second anchor wall 106 are affixed to the axles 132, 134 and the spacing rods 136, 138, the first anchor wall 104 and the second anchor wall 106 are secured together in a parallel and edge aligned manner. The axles 132, 134 and the spacing rods 136, 138 may be secured to the first anchor wall 104 and the second anchor wall 106 using a suitable fastener, such as a screw, a bolt, a pin, a rivet, a weld, an adhesive, or the like.

Figure 3:
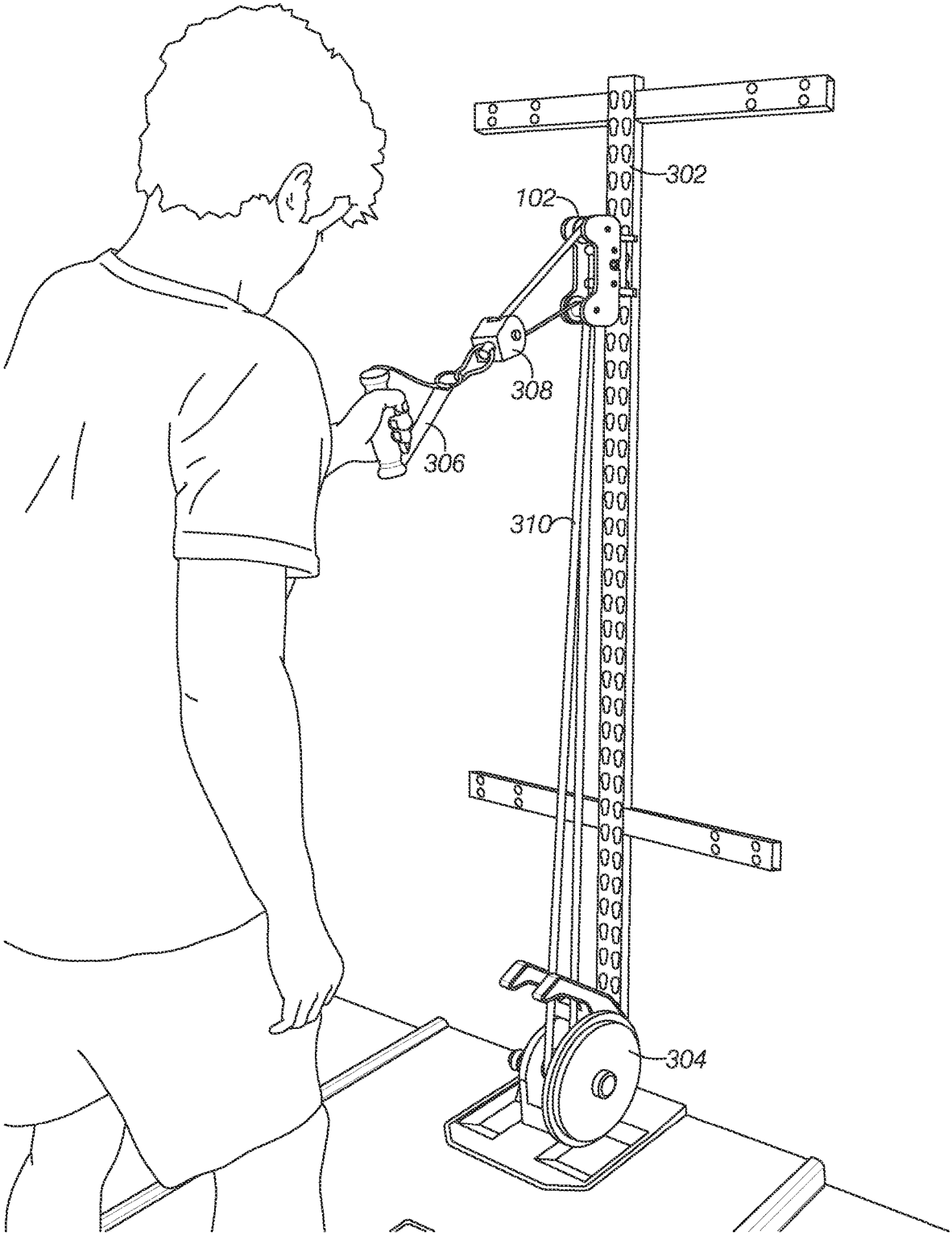
FIG. 3 is a view of a user exercising using a fly wheel resistance workout system with the example removeable anchor attached to a wall brace.

FIG. 3 is a view of a user exercising using a fly wheel resistance workout system 100 with the example removeable anchor 102 attached to a wall brace 302 that is secured to a wall surface. A fly wheel resistance device 304 is mounted to the floor surface just below the wall brace 302. The upright standing user is shown as grasping a grab bar 306 that is coupled to the fly wheel resistance device 304 via a non-limiting strap 310. The strap 310 has a first strap end and a second strap end that are coupled to the fly wheel resistance device 304 via the removeable anchor 102 and the grab bar 306 (that may have an optional pulley). When the user draws the grab bar 306 towards themself, the fly wheel resistance device 304 generates resistance in opposition to the user's pulling effort. A pulley device 308 may be used to couple the grab bar 306 and the strap 310 to facilitate movement of the strap during the exercise movement. The strap 310 is threaded through the removeable anchor 102 so as to direct the strap 310 in the requisite directions to that the user is able to exercise with the fly wheel resistance workout system 100.

Figure 4:
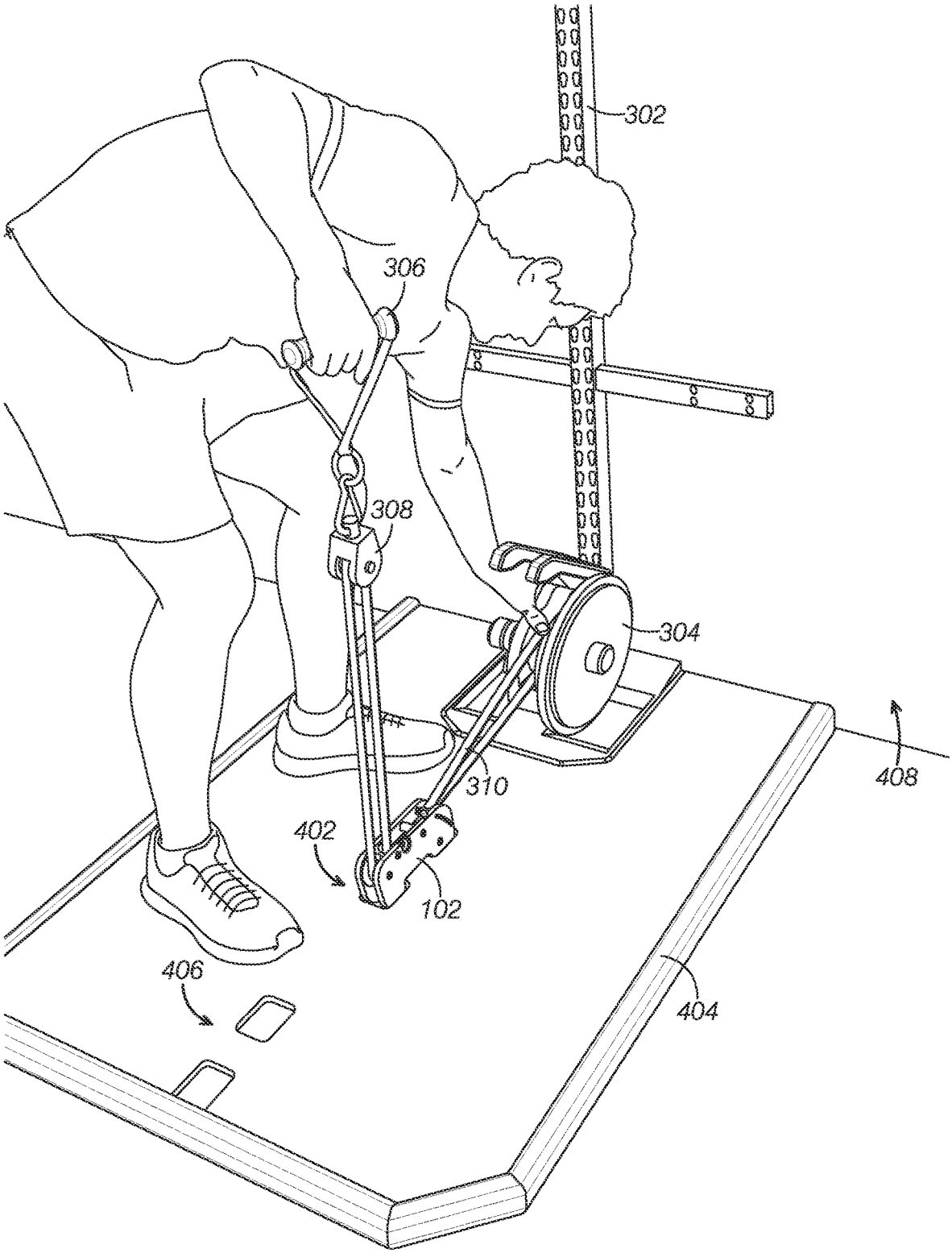
FIG. 4 is a view of a user exercising using the fly wheel resistance workout system with the example removeable anchor attached to a floor brace.

FIG. 4 is a view of a user exercising using the fly wheel resistance workout system 100 with the example removeable anchor 102 attached to an example first floor brace 402 that is secured to a floor surface 404. The upright standing user is shown as grasping the same grab bar 306 that is coupled to the same fly wheel resistance device 304 via the same non-limiting strap 310. When the user draws the grab bar 306 towards themself, the fly wheel resistance device 304 again generates resistance in opposition to the user's pulling effort. The strap 310 is threaded through the removeable anchor 102 so as to direct the strap 310 in the requisite directions to that the user is able to exercise with the fly wheel resistance workout system 100

An unexpected benefit is that the user is able to change the location of the removeable anchor 102 from the wall surface 408 to the floor surface 404, from the floor surface 404 to the wall surface 408, and/or from one location to a second location on the wall or the floor, without having to dissemble the fly wheel resistance workout system 100. Here, the user simply detaches the removeable anchor 102 from the wall surface 408 and then re-attaches the removeable anchor 102 to the floor surface 404 to change the fly wheel resistance workout system 100 shown in FIG. 3 to the fly wheel resistance workout system 100 as shown in FIG. 4. Conversely, the user may detach the removeable anchor 102 from the wall surface 408 and then re-attach the removeable anchor 102 to the floor surface 404 to change the fly wheel resistance workout system 100 shown in FIG. 4 to the fly wheel resistance workout system 100 as shown in FIG. 3.

In a preferred embodiment, the floor braces 402, 406 and the fly wheel resistance device 304 are secured to a floor surface 404. In some embodiments, the floor surface 404 may include a plurality of other floor braces, such as the exemplary non-limiting floor brace 406. Here, the plurality of floor braces 402, 406 are each located at varying distances from the fly wheel resistance workout system 100. Accordingly, the user may adjust the location of the removeable anchor 102 on the floor surface 404 to vary the nature of their exercise movement. Similarly, the exemplary non-limiting wall brace 302 has a plurality of attachment points (defined by attachment openings) that are each located at varying distances from the fly wheel resistance device 304. Here, the user may adjust the location of the removeable anchor 102 on the wall brace 302 to vary the nature of their exercise movement.

Figure 5:
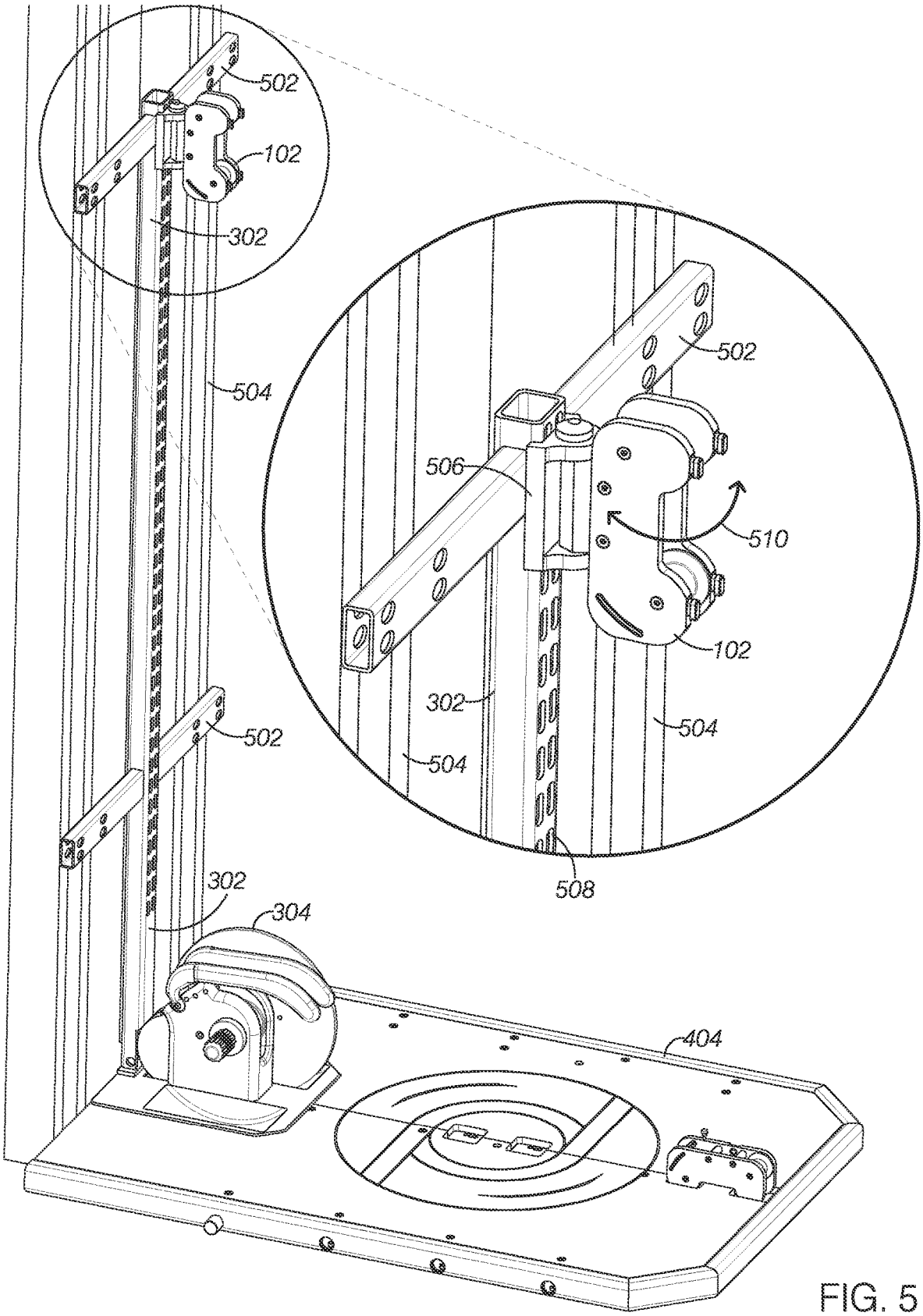
FIG. 5 is a perspective view of an embodiment of the removeable anchor removably coupled to a wall brace.

FIG. 5 is a perspective view of an embodiment of the removeable anchor 102 removably coupled to a wall brace 302. To conceptually illustrate attachment of the wall brace 302 to a wall surface (not shown), the wall brace 302 is illustrated as having a plurality of mounting brackets 502 that are attachable to a plurality of wood supports 504. For example, a plurality of two-by-four wood timbers 504 may be built as part of the wall surface (that is covered with sheet rock, for example). Other types of supports may be used in alternative installations. Lag screws, bolts of the like can then be used to secure the mounting brackets 502 of the wall brace 302 to the wall supports 504.

In a non-limiting example embodiment, an optional swivel 506 is disposed between the removeable anchor 102 and the wall brace 302. In an example embodiment, the body portion of the swivel 506 is removably secured to the wall brace 302 using attachment members (the same as or similar to the attachment members 108, 110, 112, 114 of the removeable anchor 102) that are inserted through the attachment openings 508 disposed in the wall brace 302. The swivel 506 allows the removeable anchor 102 to rotate about a horizontal plane 510. The body portion of the swivel 506 further includes upwardly and outwardly protruding hooks 1210, 1212 (FIG. 12) that secure the first retainer bar 120 and the second retainer bar 122. Any number of hooks now known or later devised are intended to be within the scope of this disclosure and to be protected by the accompanying claims.

In practice, the user may be pulling the grab bar 306 (not shown) in an arc or the like for a particular exercise movement. The swivel 506 allows the removeable anchor 102 to rotate along the horizontal plane 510 so as to keep the strap 310 aligned with the location of the grab bar 306 during the exercise movement. An unexpected advantage of the swivel 506 is to reduce the likelihood of the moving strap 306 becoming entangled in the interior region of the removeable anchor 102.

FIG. 5 also illustrates that the bottom of the wall brace 302 may be optionally secured to the fly wheel resistance workout system 100. This alternative embodiment provides for a more stable and secure fly wheel resistance workout system 100.

Figure 6:
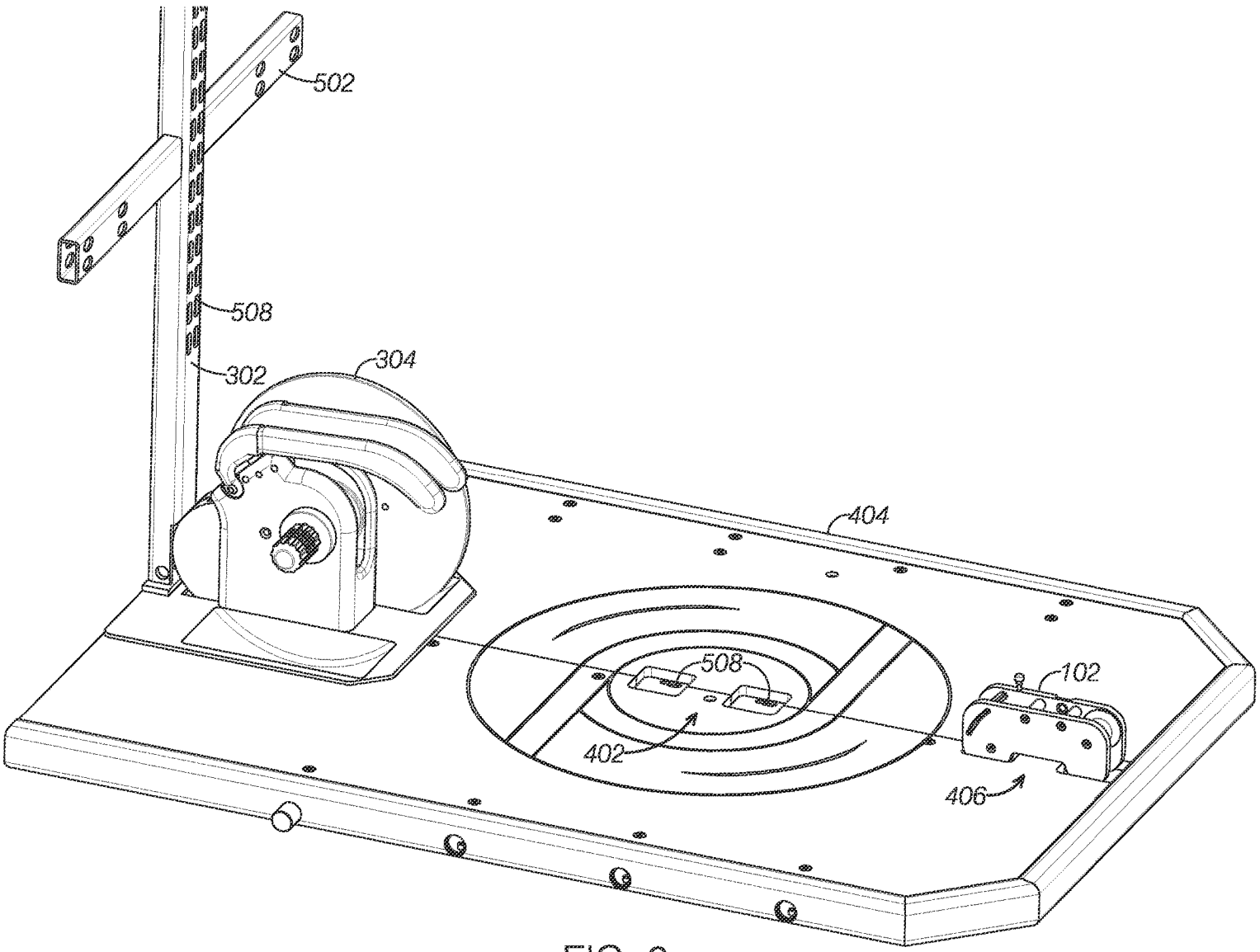
FIG. 6 is a perspective view of an embodiment of the removeable anchor removably coupled to a selected floor brace.

FIG. 6 is a perspective view of an embodiment of the removeable anchor 102 removably coupled to a selected floor brace 406. One skilled in the art appreciates that tension in the strap between the fly wheel resistance device 304 and the removeable anchor 102 keep the attachment members 108, 110, 112, 114 secured within the attachment openings 508 while the user is performing a particular exercise movement. To detach the removeable anchor 102 from the floor brace 406 the user grasps the removeable anchor 102 and pulls the removeable anchor 102 back away from the fly wheel resistance device 304. Then, the user may lift the removeable anchor 102 upward to detach the removeable anchor 102 from the floor brace 406.

Figure 7:
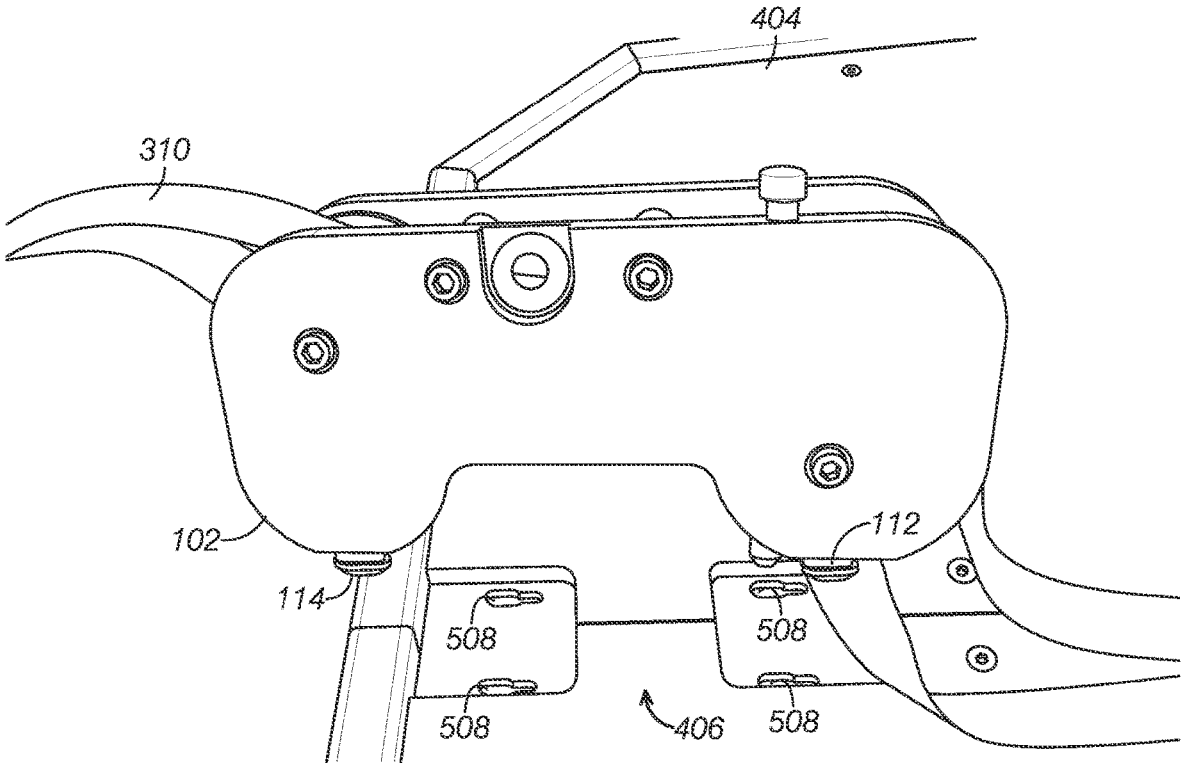
FIG. 7 is a view of the removeable anchor prior to being coupled to the floor brace.

FIG. 7 is a view of the removeable anchor 102 prior to being coupled to the floor brace 406. The user may then step forward and place the attachment members 108, 110, 112, 114 into the attachment openings 508 of the floor brace 406. The user then pushes the removeable anchor 102 forward towards the fly wheel resistance device 304 to secure the removeable anchor 102 into the floor brace 406.

Figure 8:
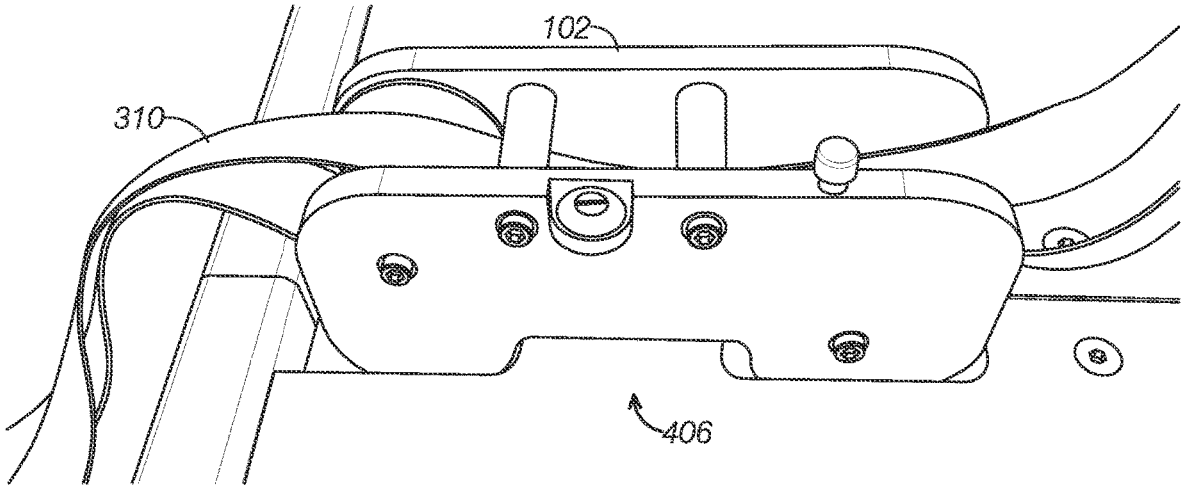
FIG. 8 is a view of a strap that is fed through the removeable anchor coupled to the floor brace and to the fly wheel resistance device.

FIG. 8 is a view of a strap 310 that is fed through the removeable anchor 102 coupled to the floor brace 406 and to the fly wheel resistance device 304 (FIG. 3). Here, the removeable anchor 102 is secured to the floor brace 406. The user simply adjusts the straps and grab bar 306 in a desired initial arrangement, and can then begin their exercise movement.

Figure 9:
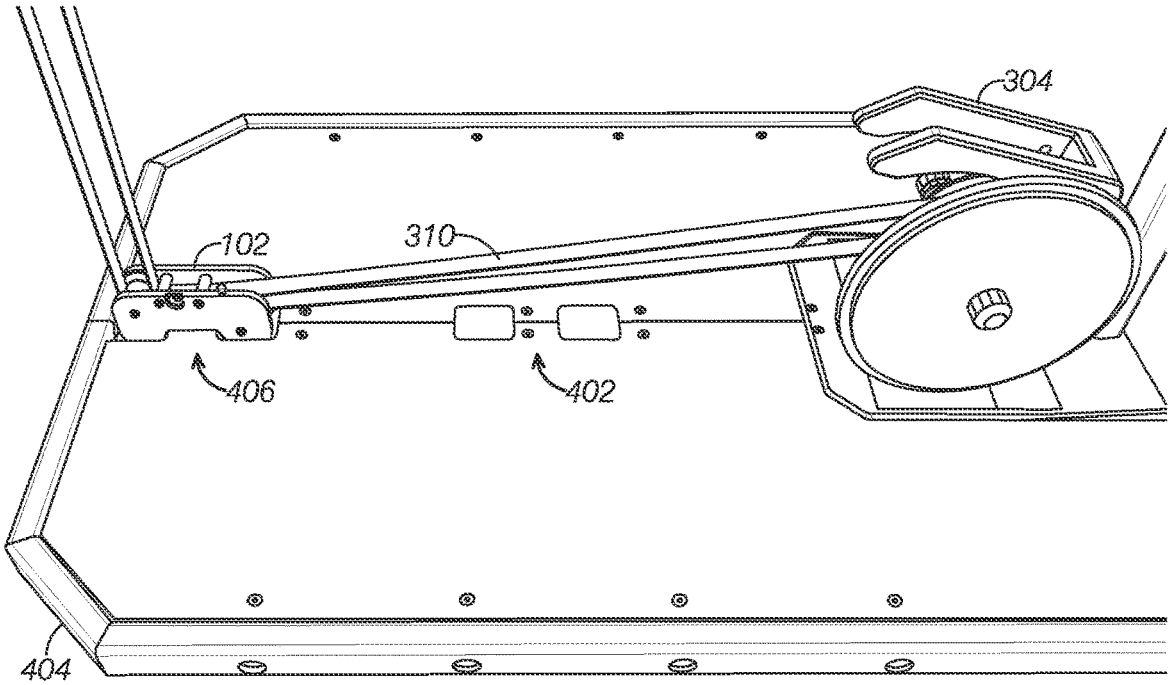
FIG. 9 is a view of a strap that is fed through the removeable anchor coupled to the floor brace and to the fly wheel resistance device.
Figure 10:
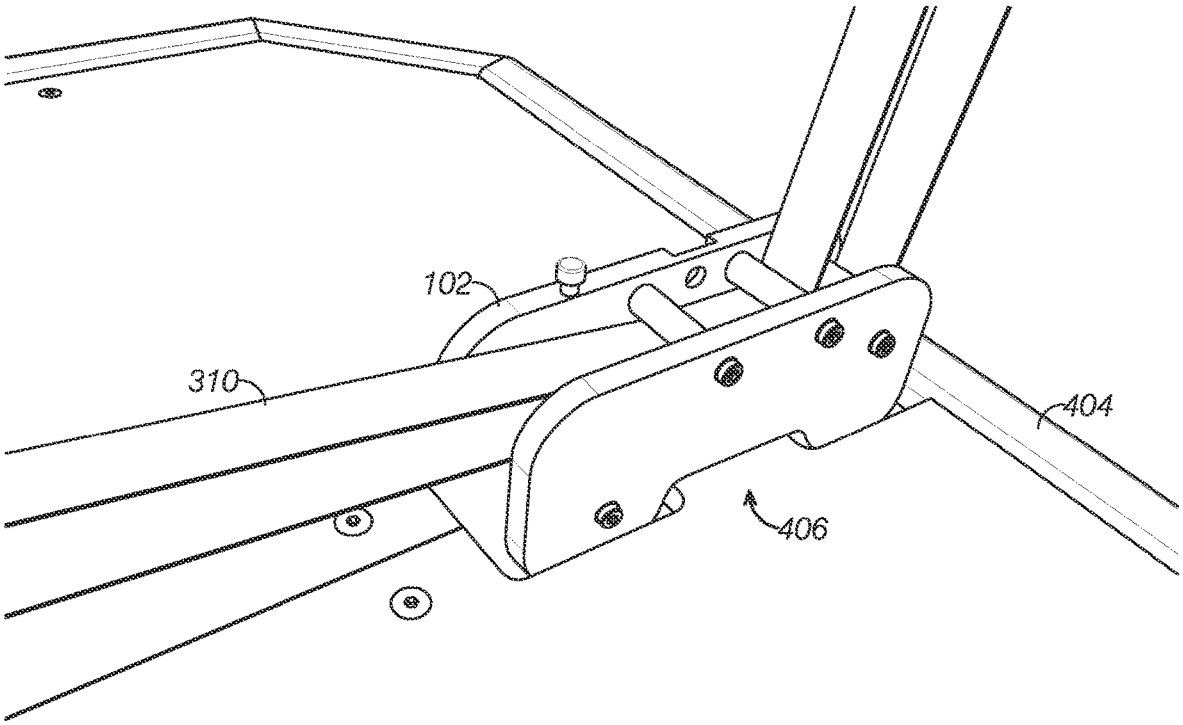
FIG. 10 is a view of a strap that is fed through the removeable anchor coupled to the floor brace.

FIG. 9 is a view of a strap 310 that is fed through the removeable anchor 102 coupled to the floor brace 406. The strap 310 is coupled to the grab bar 306 and to the fly wheel resistance device 304. FIG. 10 is a close up view of the strap 310 that is fed through the removeable anchor 102 coupled to the floor brace 406.

Figure 11:
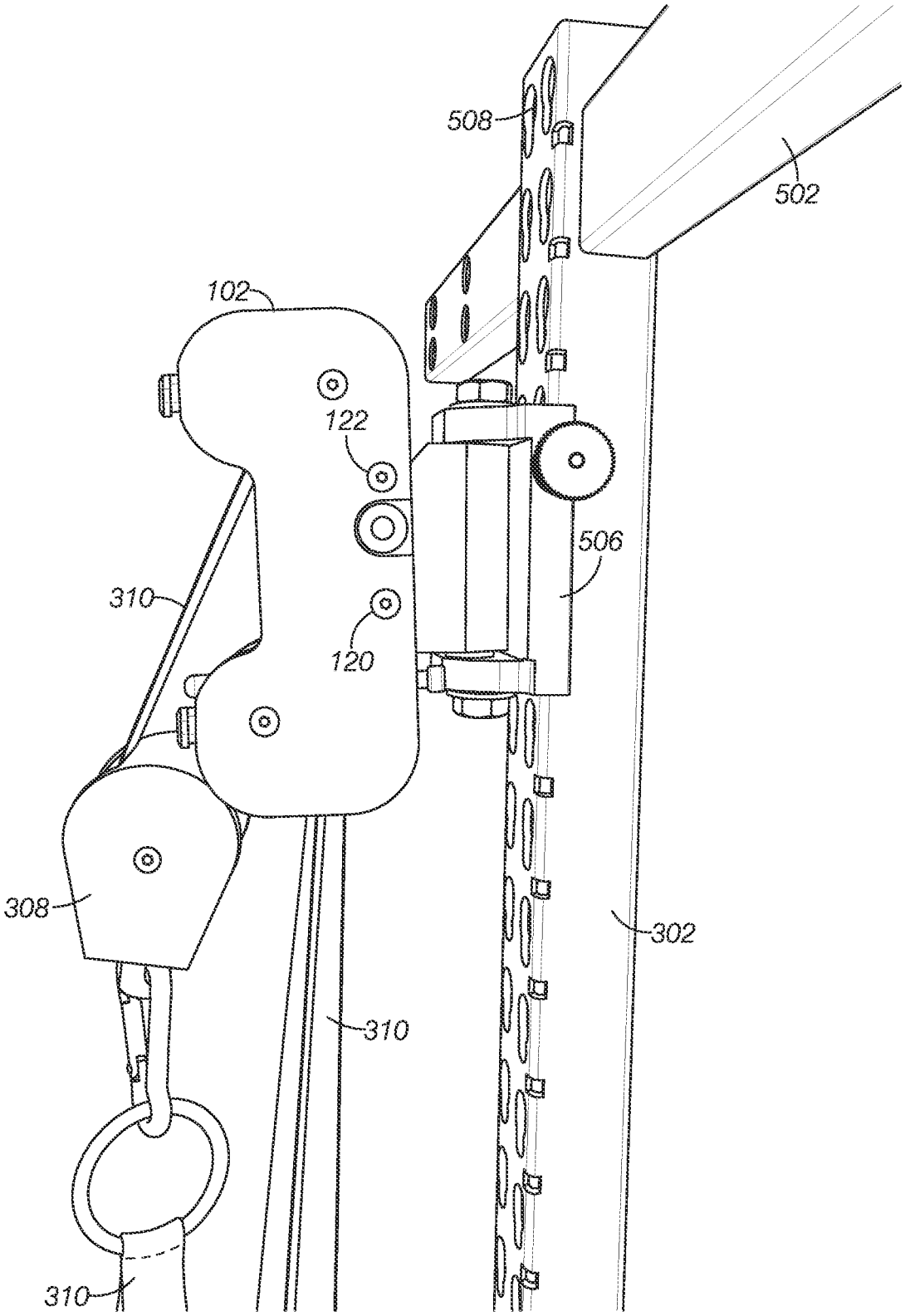
FIG. 11 is a view of the removeable anchor coupled to an optional swivel that is removably coupled to the wall brace.

FIG. 11 is a close up perspective view of the removeable anchor 102 coupled to an optional swivel 506. The swivel 506 is removably coupled to the wall brace 302. The swivel 506 is secured to the wall brace 302 using a plurality of attachment members (similar to or equivalent to attachment members 108, 110, 112, 114) that are secured into the attachment openings 508 disposed along the length of the wall brace 302. Depending upon the particular exercise movement of interest, the user may easily relocate the swivel 506 to any desire elevation along the wall brace 302.

Figure 12:
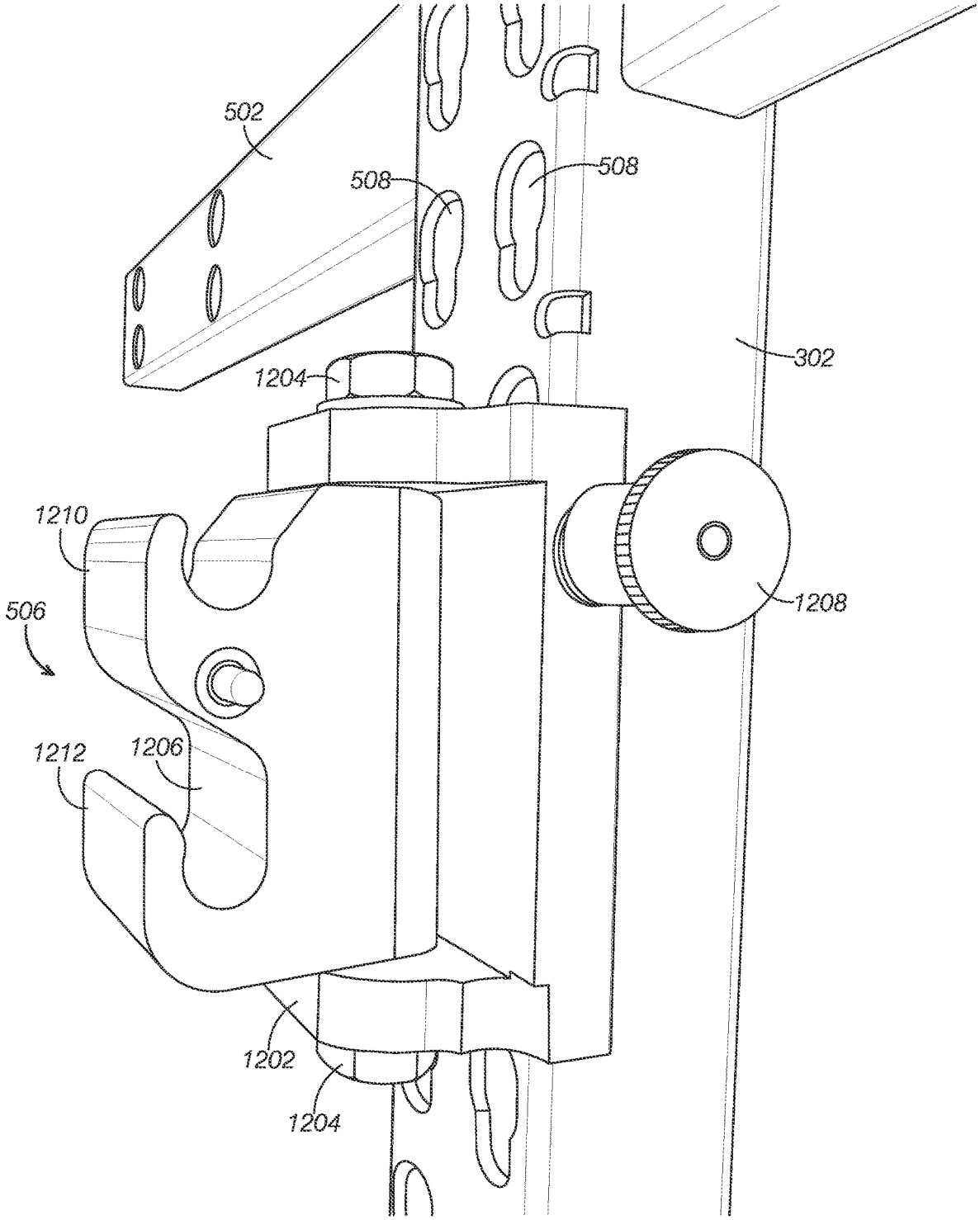
FIG. 12 is a perspective view of the swivel.

FIG. 12 is a perspective view of the swivel 506. The swivel 506 comprises a body member 1202, a pin 1204 and an anchor securing member 1206. In an example embodiment, the body portion is a U-bracket or the like having holes (apertures) disposed in the outwardly extending upper and lower brackets. The anchor securing portion 1206 is sized to fit between the two outwardly extending brackets, and has a corresponding hole (aperture) extending through the length of the anchor securing portion 1206. When the anchor securing portion 1206 is placed between the brackets of the body portion 1202 such that the holes are aligned, the pin 1204 is extended through the holes to secure the body portion 1202 and the anchor securing portion 1206 together, while allowing the anchor securing portion 1206 to rotate along a horizontal plane. Alternative embodiments may use any suitable swivel structure for the swivel 506. All such hinge modifications and hinge variations are intended to be included herein within the scope of this disclosure and protected by the following claims.

The body portion 1202 includes a plurality of attachment members (similar to the attachment members 108, 110, 112, 114 of the removeable anchor 102) that are configured to secure the swivel 506 to the mating attachment openings 508 disposed in the wall brace 302. Some embodiments include an optional locking pin 1208 that locks the swivel 506 in the selected location on the wall brace 302.

The anchor securing portion 1206 comprises an upper hook 1210 that extends outwardly and upwardly from the body of the anchor securing portion 1206. The anchor securing portion 1206 also comprises a lower hook 1212 disposed below the upper hook 1210 that also extends outwardly and upwardly from the body of the anchor securing portion 1206. The hooks 1210 and 1212 are configured to mate with and to releasably secure the removeable anchor 102 to the swivel 506.

Figure 13:
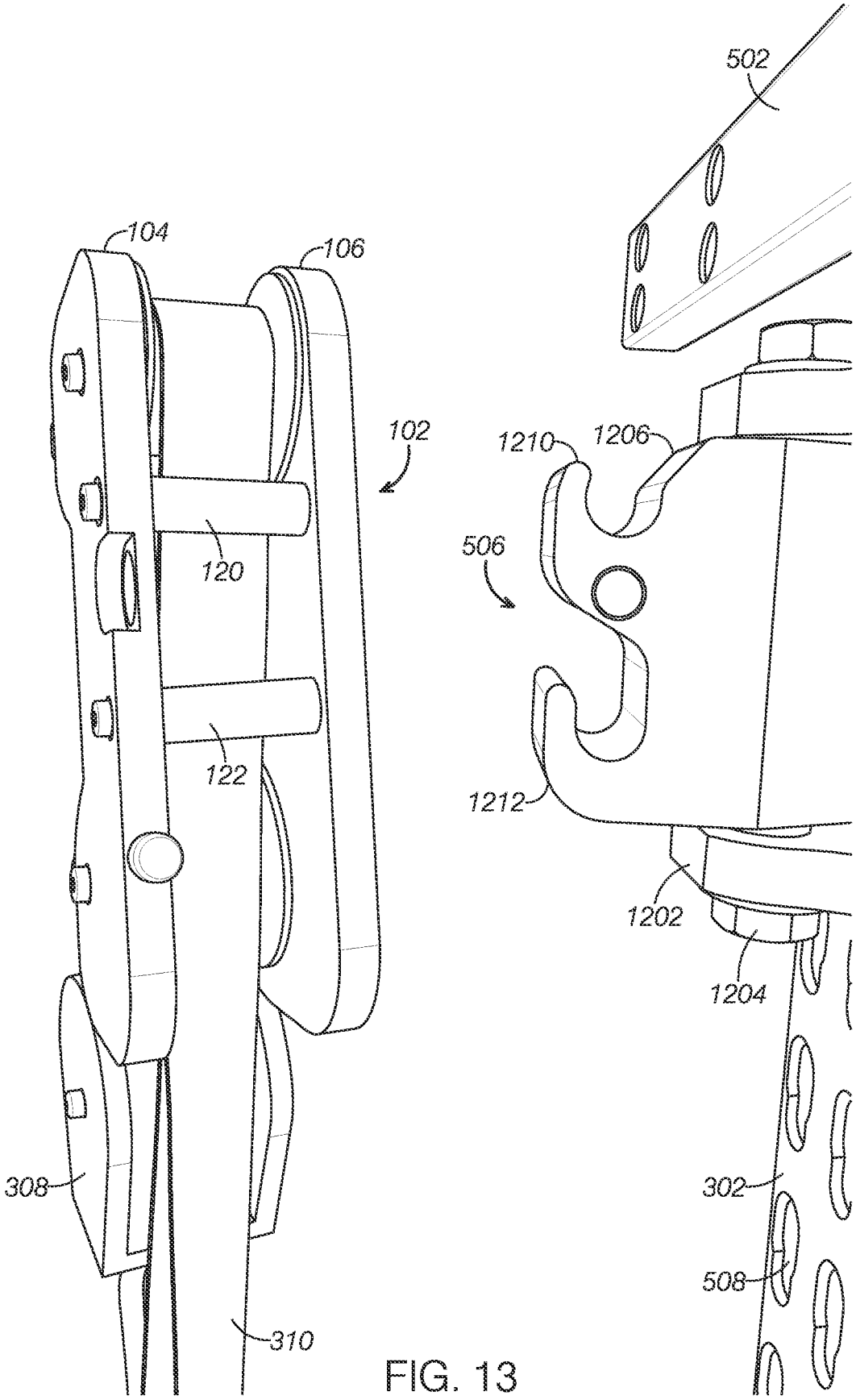
FIG. 13 is a view of the removeable anchor being removably coupled to the swivel.

FIG. 13 is a view of the removeable anchor 102 being removably coupled to the swivel 506. Here, the user places the removeable anchor 102 so that the first retainer bar 120 engages with the upper hook 1210 and so that the second retainer bar 122 concurrently engages with the lower hook 1212. The user pulls the removeable anchor 102 downward so that the upwardly and outwardly protruding hooks 1210, 1212 engage the retainer bars 120, 122 to secure the removeable anchor 102 to the swivel 506. In practice, the user simply grasps the removeable anchor 102 from a previous location, raises the removeable anchor 102 up to the swivel 506, and then secures the removeable anchor 102 to the swivel 506 which has already been positions on the wall brace 302. One skilled in the art appreciates that after some amount of practice, the user can move the removeable anchor 102 to the swivel 506 in a matter of second, thereby minimizing disruption of the user's concentration and/or workout effort.

Figure 14:
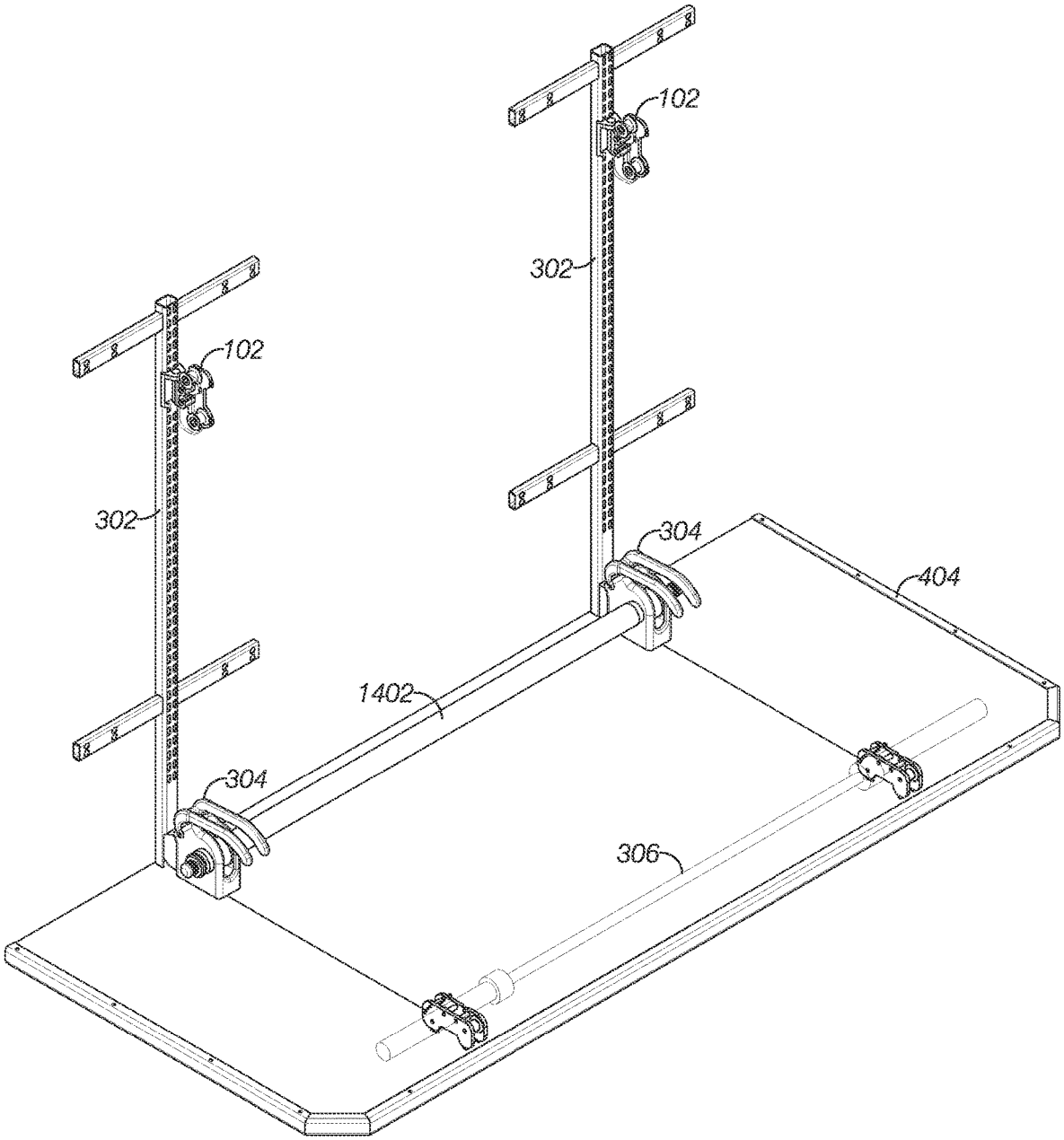
FIG. 14 is a tandem fly wheel resistance workout system 100 embodiment.

FIG. 14 is a tandem fly wheel resistance workout system 100 embodiment. In this example embodiment, two fly wheel resistance devices 304 are coupled to an elongated grab bar 306 using a strap, rope, cable, or the like (not shown). A spacer bar 1402 secures the two fly wheel resistance devices 304 so that the operate together in tandem. In practice, the user may secure the two removeable anchors 102 to the wall using two swivels 506 secured to the two wall braces 302. Alternatively, the user may secure the two removeable anchors 102 to the floor surface 404.

Figure 15:
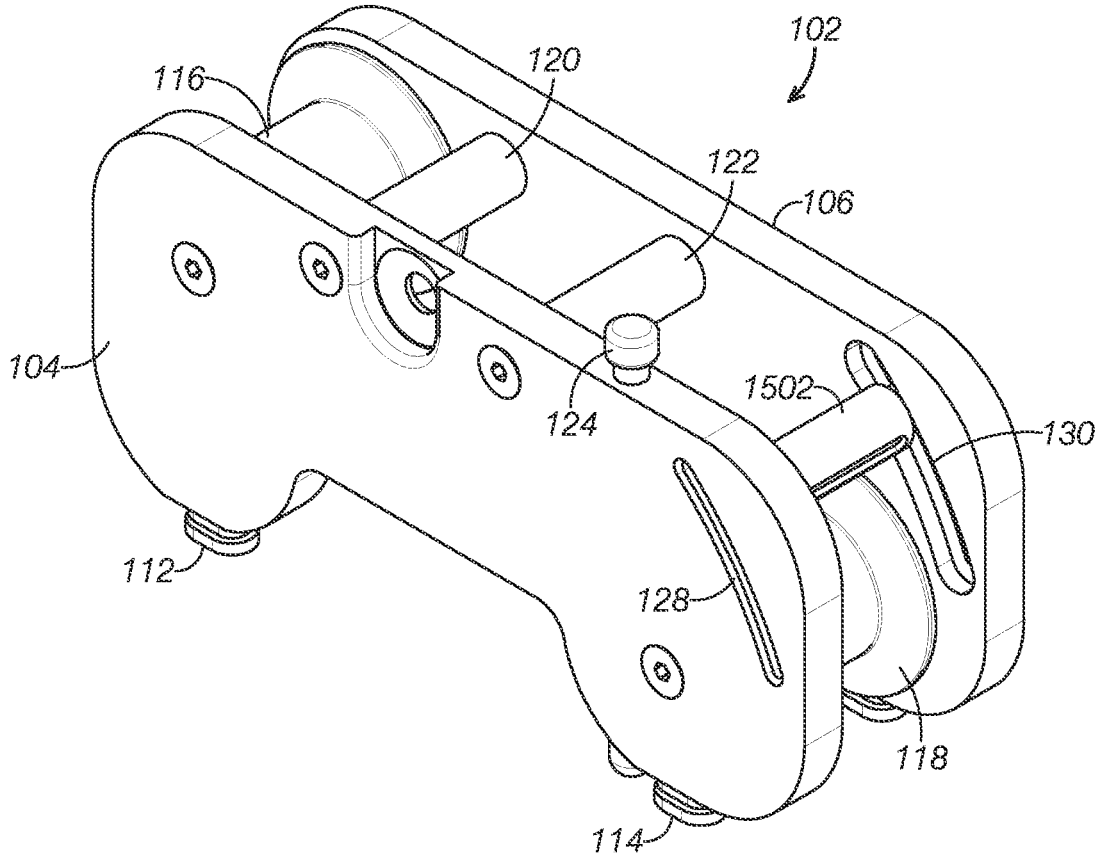
FIG. 15 illustrates an anti-twist pin slidably secured by the radial slots.

FIG. 15 illustrates an anti-twist pin 1502 slidably secured by the anchor radial slots 128, 130. The ends of the anti-twist pin 1502 extend into the anchor radial slots 128, 130. The anti-twist pin 1502 prevents the strap 310 (not shown) from twisting as the user performs their exercise movements and/or when the user repositions the removeable anchor 102. The anti-twist pin 1502 may freely slide within the anchor radial slots 128, 130 as needed to prevent strap twisting.

It should be emphasized that the above-described embodiments of the fly wheel resistance workout system 100 are merely possible examples of implementations of the invention. Many variations and modifications may be made to the above-described embodiments. All such modifications and variations are intended to be included herein within the scope of this disclosure and protected by the following claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

Therefore, having thus described the invention, at least the following is claimed:

1. A fly wheel resistance workout system, comprising:

a plurality of braces secured into at least one of a floor surface and a wall surface, wherein each one of the plurality of braces on the at least one of the floor surface and the wall surface is located at a predefined location on the at least one of the floor surface and the wall surface;

a removeable anchor that can be releasably secured to one of the plurality of braces such that the removeable anchor is secured to the at least one of the floor surface and the wall surface at a location of interest;

a grab bar that is configured to be grasped by a user during an exercise motion;

a fly wheel resistance device that is configured to oppose the exercise motion made by the user; and a strap coupled to the fly wheel resistance device, wherein the strap is coupled to the grab bar and moves freely through the removeable anchor during the exercise motion.

2. The fly wheel resistance workout system of claim 1, wherein each one of the plurality of braces comprises a plurality of attachment openings, and wherein the removeable anchor comprises:

a plurality of attachment members, wherein each attachment member extends outwardly from an exterior surface of the removeable anchor, wherein each one of the plurality of attachment members is configured to be received by a corresponding one of the plurality of attachment openings on the respective brace, and wherein the removeable anchor is secured in place when the plurality of attachment members are engaged with the corresponding ones of the plurality of attachment openings.

3. The fly wheel resistance workout system of claim 2, wherein the removeable anchor further comprises:

a first anchor wall, wherein a first one and a second one of the plurality of attachment members extend outwardly from a first exterior surface of the first anchor wall; and a second anchor wall, wherein a third one and a fourth one of the plurality of attachment members extend outwardly from a second exterior surface of the second anchor wall.

4. The fly wheel resistance workout system of claim 1, wherein at least one of the plurality of braces is a wall brace secured onto the wall surface, and the fly wheel resistance workout system further comprises:

a swivel configured to couple the removeable anchor to the wall brace of the plurality of braces, wherein a body portion of the swivel is configured to rotate about a horizontal plane.

5. The fly wheel resistance workout system of claim 4, wherein the swivel comprises a hook that extends outwardly and upwardly from the body portion of the swivel, and wherein the removeable anchor comprises:

a retainer bar disposed proximate to an exterior surface of the removeable anchor, wherein the removeable anchor is secured to the wall brace when the retainer bar is placed within the hook of the swivel, and wherein the swivel enables the removeable anchor to rotate about the horizontal plane during the exercise motion of the user.

6. The fly wheel resistance workout system of claim 5, wherein the hook is a first hook of the swivel, wherein the retainer bar is a first retainer bar of the removeable anchor, wherein the removeable anchor further comprises a second retainer bar that is parallel to the first retainer bar;

wherein the swivel further comprises a second hook that extends outwardly and upwardly from the body portion of the swivel, and wherein the removeable anchor is secured to the wall brace when the first retainer bar is placed within the first hook and when the second retainer bar is placed within the second hook of the swivel.

7. The fly wheel resistance workout system of claim 4, wherein the wall brace defines a plurality of attachment openings, and wherein swivel comprises:

a plurality of attachment members, wherein each attachment member extends outwardly from an exterior surface of the swivel, and wherein each one of the plurality of attachment members is configured to be engaged with a corresponding one of the plurality of attachment openings of the wall brace.

8. The fly wheel resistance workout system of claim 7, wherein the plurality of attachment openings are each defined by a keyhole slot and a keyhole opening, wherein the plurality of attachment members of the swivel are each defined by a protruding shaft and a terminal lock nut at a distal end of the protruding shaft, and wherein the swivel is secured in place when the plurality of attachment members are respectively inserted into the keyhole openings and when the protruding shafts are then slidably moved into the corresponding ones of the keyhole slots, respectively.

9. The fly wheel resistance workout system of claim 1, wherein the removeable anchor further comprises:

a first anchor wall; and a second anchor wall, wherein the first anchor wall is parallel and edge aligned with the second anchor wall.

10. The fly wheel resistance workout system of claim 9, wherein the removeable anchor further comprises:

a first pulley;

a second pulley;

a first axle inserted through a center of the first pulley and sized to permit the first pulley to freely rotate around the first axle; and a second axle inserted through a center of the second pulley and sized to permit the second pulley to freely rotate around the second axle, wherein a first end of the first axle is secured to the first anchor wall and a second end of the first axle is secured to the second anchor wall, wherein a first end of the second axle is secured to the first anchor wall and a second end of the second axle is secured to the second anchor wall, wherein the secured first axle and the secured second axle cooperate to fix the first anchor wall and the second anchor wall at respective parallel and edge aligned positions, and wherein the strap is drawn through the first pulley and the second pulley of the removeable anchor of the fly wheel resistance workout system during the exercise motion being performed by the user.

11. The fly wheel resistance workout system of claim 10, wherein the removeable anchor further comprises:

a first retainer bar; and a second retainer bar, wherein a first end of the first retainer bar is secured to the first anchor wall and a second end of the first retainer bar is secured to the second anchor wall, wherein a first end of the second retainer bar is secured to the first anchor wall and a second end of the second retainer bar is secured to the second anchor wall, wherein the secured first retainer bar and the secured second retainer bar cooperate to fix the first anchor wall and the second anchor wall at respective parallel and edge aligned positions, and wherein the strap is drawn through the first pulley and the second pulley of the removeable anchor of the fly wheel resistance workout system during the exercise motion being performed by the user.

12. The fly wheel resistance workout system of claim 9, wherein the removeable anchor further comprises:

a first pulley;

a second pulley;

a first axle inserted through a center of the first pulley and sized to permit the first pulley to freely rotate around the first axle;

a second axle inserted through a center of the second pulley and sized to permit the second pulley to freely rotate around the second axle;

a first retainer bar; and a second retainer bar, wherein a first end of the first axle is secured to the first anchor wall and a second end of the first axle is secured to the second anchor wall, wherein a first end of the second axle is secured to the first anchor wall and a second end of the second axle is secured to the second anchor wall, wherein a first end of the first retainer bar is secured to the first anchor wall and a second end of the first retainer bar is secured to the second anchor wall, wherein a first end of the second retainer bar is secured to the first anchor wall and a second end of the second retainer bar is secured to the second anchor wall, wherein the secured first axle, the secured second axle, the secured first retainer bar, and the secured second retainer bar cooperate to fix the first anchor wall and the second anchor wall at respective parallel and edge aligned positions, and wherein the strap is drawn through the first pulley and the second pulley of the removeable anchor of the fly wheel resistance workout system during the exercise motion being performed by the user.

13. The fly wheel resistance workout system of claim 12, wherein an outside surface of the first retainer bar and an outside surface of the second retainer bar are coated with a material that has a low friction coefficient that is less than a friction coefficient of a material of the first and second retainer bars, and wherein the low friction coefficient reduces frictional drag exerted on the strap by the removable anchor as the user is performing the exercise motion using the fly wheel resistance workout system that is coupled to the strap.

14. The fly wheel resistance workout system of claim 9, wherein a first curved anchor radial slot is disposed in the first anchor wall proximate to a leading edge of the first anchor wall, wherein a second curved anchor radial slot is disposed in the second anchor wall proximate to a leading edge of the second anchor wall, and wherein the removeable anchor further comprises:

an anti-twist pin, wherein a first end of the anti-twist pin extends into the first curved anchor radial slot, wherein a second end of the anti-twist pin extends into the second curved anchor radial slot, wherein the anti-twist pin may freely slide within the first curved anchor radial slot and the second curved anchor radial slot, wherein the anti-twist pin is configured to prevent the strap from twisting as the user repositions the removeable anchor, and wherein the anti-twist pin is configured to prevent the strap from twisting as the user performs the exercise motion.

15. A removeable anchor used in a fly wheel resistance workout system, the removeable anchor comprising:

a first anchor wall and a second anchor wall, wherein a body portion of the first anchor wall and a body portion of the second anchor wall have a same shape, and wherein the first anchor wall is parallel and edge aligned with the second anchor wall;

a first pulley;

a second pulley;

a first axle inserted through a center of the first pulley and sized to permit the first pulley to freely rotate around the first axle; and a second axle inserted through a center of the second pulley and sized to permit the second pulley to freely rotate around the second axle, wherein a first end of the first axle a is secured to the first anchor wall and a second end of the first axle is secured to the second anchor wall, wherein a first end of the second axle is secured to the first anchor wall and a second end of the second axle is secured to the second anchor wall, wherein the secured first axle and the secured second axle cooperate to fix the first anchor wall and the second anchor wall at respective parallel and edge aligned positions, and wherein one of a strap, a rope, or a cable is configured to be drawn through the first pulley and the second pulley of the removeable anchor used in the fly wheel resistance workout system during an exercise movement being performed by a user.

16. The removeable anchor of claim 15, further comprising:

a first retainer bar;

a second retainer bar;

wherein a first end of the first retainer bar is secured to the first anchor wall and a second end of the first retainer bar is secured to the second anchor wall, wherein a first end of the second retainer bar is secured to the first anchor wall and a second end of the second retainer bar is secured to the second anchor wall, and wherein the secured first retainer bar and the secured second retainer bar cooperate with the first axle and the second axle to fix the first anchor wall and the second anchor wall at respective parallel and edge aligned positions.

17. The removeable anchor used in the fly wheel resistance workout system, as claimed in claim 15, wherein the fly wheel resistance workout system comprises a plurality of braces secured into at least one of a floor surface and a wall surface, wherein each one of the plurality of braces on the at least one of the floor surface and the wall surface is located at a predefined location on the at least one of the floor surface and the wall surface, and wherein each one of the plurality of braces comprises a plurality of attachment openings, the removeable anchor further comprising:

a plurality of attachment members, each attachment member extending outwardly from an exterior surface of the removeable anchor, wherein each one of the plurality of attachment members is configured to be respectively received by a corresponding one of the plurality of attachment openings, wherein the removeable anchor is configured to be secured in place when the plurality of attachment members are respectively engaged with the corresponding ones of the plurality of attachment openings, and wherein the removeable anchor is configured to be selectively secured to one of the plurality of braces such that the removeable anchor is secured to the at least one of the floor surface and the wall surface at a location of interest.

18. The removeable anchor of claim 15, wherein a first curved anchor radial slot is disposed in the first anchor wall proximate to a leading edge of the first anchor wall, wherein a second curved anchor radial slot is disposed in the second anchor wall proximate to a leading edge of the second anchor wall, and wherein the removeable anchor further comprises:

an anti-twist pin, wherein a first end of the anti-twist pin extends into the first curved anchor radial slot, wherein a second end of the anti-twist pin extends into the second curved anchor radial slot, wherein the anti-twist pin may freely slide within the first curved anchor radial slot and the second curved anchor radial slot, wherein the anti-twist pin is configured to prevent the one of the strap, the rope, and the cable from twisting as the user repositions the removeable anchor in the fly wheel resistance workout system, and wherein the anti-twist pin is configured to prevent the one of the strap, the rope, and the cable from twisting as the user performs the exercise movement.

* * * * *